US007797783B2

(12) United States Patent
Chandler et al.

(10) Patent No.: US 7,797,783 B2
(45) Date of Patent: Sep. 21, 2010

(54) GOLF GRIP TOWEL

(75) Inventors: Wright Bronson Chandler, Pinehurst, NC (US); Dennis Del Rey, San Diego, CA (US)

(73) Assignee: Eaton Corporation, Cleveland, OH (US)

( * ) Notice: Subject to any disclaimer, the term of this patent is extended or adjusted under 35 U.S.C. 154(b) by 1321 days.

(21) Appl. No.: 11/265,026

(22) Filed: Nov. 2, 2005

(65) Prior Publication Data

US 2007/0094826 A1 May 3, 2007

(51) Int. Cl.
*A63B 47/04* (2006.01)
*A63B 57/00* (2006.01)

(52) U.S. Cl. ..... 15/209.1; 15/118

(58) Field of Classification Search ..... 15/210.1, 15/118, 209.1, 227
See application file for complete search history.

(56) References Cited

U.S. PATENT DOCUMENTS 3,397,891 A * 8/1968 Koch ..... 473/298
4,912,800 A * 4/1990 Zeltner ..... 15/114
5,215,136 A * 6/1993 Flanders et al. ..... 150/160
5,286,019 A * 2/1994 Watabe ..... 473/282
5,394,914 A * 3/1995 Meek ..... 150/160
5,407,723 A * 4/1995 Curtin ..... 428/124
5,615,720 A * 4/1997 O'Sullivan ..... 150/160
5,671,481 A * 9/1997 Giard ..... 2/170
5,724,698 A * 3/1998 Mondragon ..... 15/209.1
5,770,284 A * 6/1998 Logemann ..... 428/36.1
5,813,080 A * 9/1998 Hendren ..... 15/209.1
6,463,971 B1 10/2002 Kinsey ..... 150/160
7,055,534 B2 * 6/2006 Goode et al. ..... 134/22.19
7,302,728 B2 * 12/2007 Kunz ..... 15/118
2004/0194242 A1 * 10/2004 Ortega et al. ..... 15/118
2004/0197523 A1 * 10/2004 Doty ..... 428/99
2005/0198758 A1 * 9/2005 Kunz ..... 15/118
2006/0005335 A1 * 1/2006 Ortega et al. ..... 15/118
2006/0037163 A1 * 2/2006 Steinway ..... 15/209.1
2007/0039111 A1 * 2/2007 Curtis ..... 15/160
2007/0068612 A1 * 3/2007 Potter ..... 150/160

* cited by examiner

*Primary Examiner*—David B Thomas
(74) *Attorney, Agent, or Firm*—Daniel S. Kalka

(57) ABSTRACT

A golf grip towel 10 constructed of at least two panels 12,14 of different materials provides a dual purpose towel and protective cover for the handles 28 of golf clubs 30. When the golf clubs 30 are removed from the golf bag or golf cart for use on a fairway or green, the handles 28 of the clubs 30 are placed in a pocket 26 of the golf grip towel 10 to protect the golf club handles 28, when laid on the ground, from moisture, dirt, or other contamination.

8 Claims, 3 Drawing Sheets

GOLF GRIP TOWEL

BACKGROUND

1. Field

The present disclosure relates in general to a golf towel, and more specifically to a golf grip towel suitable for use as a protective cover for the handles of golf clubs for keeping the golf club handles clean and dry as well as for use as a towel.

2. Description of the Related Art

Golf is a sport that continues to increase in popularity. Golfers are always trying to find more time to be on the golf course. Often those times occur when the weather or playing conditions may not be ideal for the game, like on a hot, humid day, or in the early morning when there is still dew on the ground, or even on a rainy day when the grass and ground are still wet. These are the times a golf towel becomes a necessity for wiping your hands or for cleaning the golf club heads, golf balls, or golf handles from perspiration, dampness, dirt and grass.

When the golfer leaves the golf bag or golf cart to play through on the fairway, the golfer will carry several golf clubs to the location where the golf ball has landed. After surveying the location, distance, and other factors, the golfer will select the club believed to the best for that situation. The remaining clubs are then either propped on a nearby tree or if a towel is available laid on a towel on the ground, or some golfer have even used a golf tee inserted into the ground as a rest for the grip portion of the other clubs. In the worst case scenario, the golf clubs are laid directly on the ground. Needless to say, the grips get wet or dirty.

Thus, there is still a need for a golf towel that has a dual function or a dual purpose that allows the golf towel to be used as an ordinary towel and as a protective cover for the golf grip portions or handles on the golf clubs.

BRIEF SUMMARY

The foregoing need among others are accomplished with a golf grip towel constructed of at least two panels of different material and sized to cover a plurality of golf club handles.

The golf grip towel functions both as a towel and as a protective cover for the handle portions of golf clubs, and is particularly useful for protecting the handles of the golf clubs when the clubs are removed from the golf bag or golf cart.

The golf grip towel comprises a first panel for cleaning and a second panel for protecting the golf grip, also referred to as a handle of the golf club. The first panel of absorbent cloth material is joined to the second panel of micro fiber material around its periphery for a forming a pocket selectively sized to cover the handle of a golf club.

Advantageously, the golf towel provides the first panel of absorbent cloth material for use as a towel, and the second panel as a protective barrier to protect the golf club grips when the golf clubs are removed from the golf bag or golf cart.

The various features of novelty which characterize the present disclosure are pointed out with particularity in the claims annexed hereto and forming a part of this disclosure. For a better understanding, reference is made to the accompanying descriptive matter and drawings in which an exemplary embodiment is illustrated and described.

DETAILED DESCRIPTION

Figure 1:
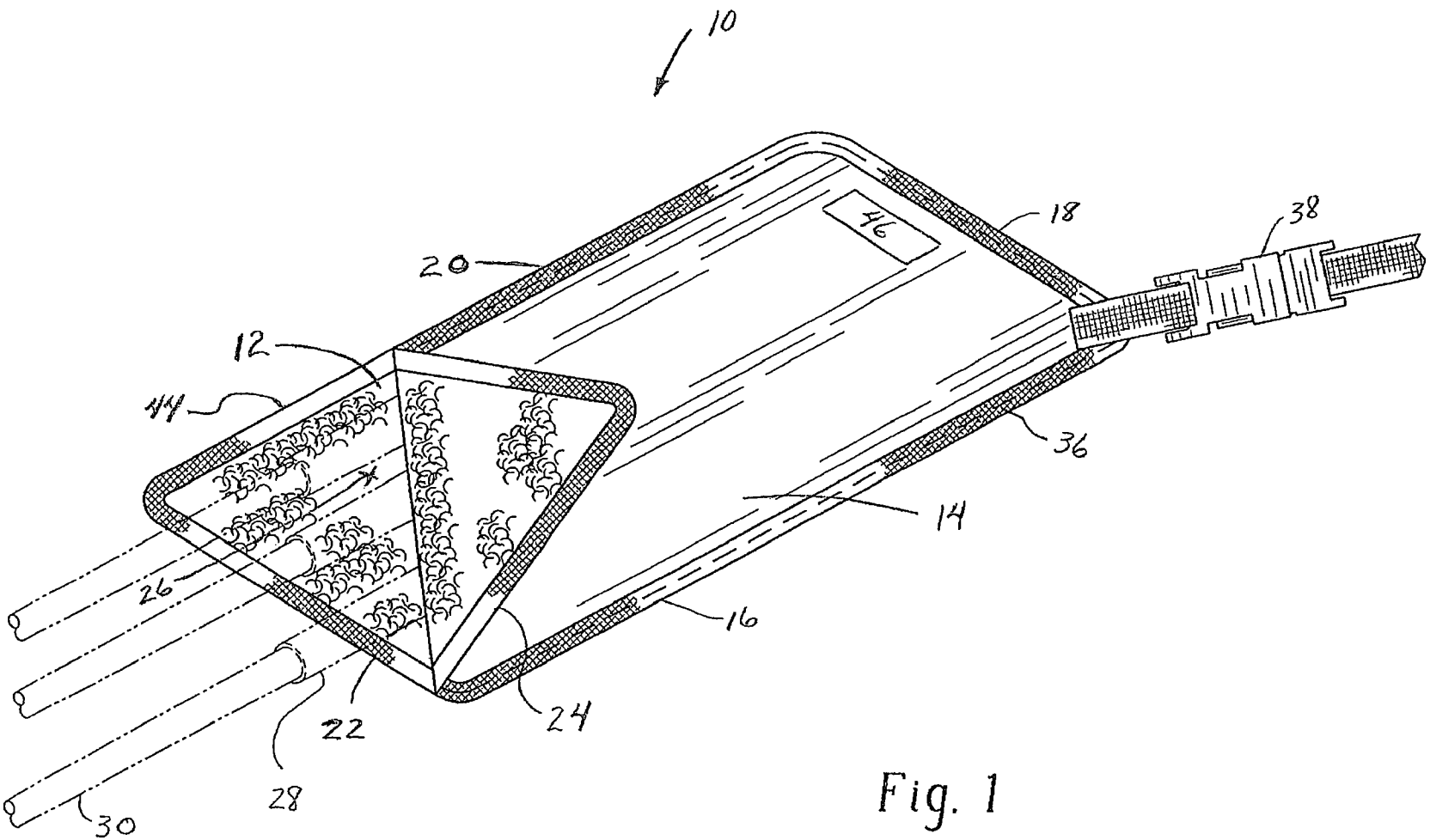
FIG. 1 is an elevated perspective view of the golf grip towel according to a first embodiment.

Referring to the figures, which are not intended to limit the disclosure thereto, and where like numerals designate like or similar features throughout the several views, and first in particular to FIG. 1, there is shown a golf grip towel generally designated 10. The golf grip towel 10 includes a first panel 12 of an absorbent material such as a micro fiber terry soft cloth material with a preferable rectangular shape. A second panel 14 of a micro fiber material like a suede soft material having a rectangular shape fairly coextensive with the first panel 12 is joined to the first panel 12 in an overlapping relationship around an edge of a first side 16, an edge of a second side 18 (also referred to herein as a top edge of the golf grip towel), and a substantial portion of an edge of a third side 20. A fourth side 22 (also referred to herein as a bottom edge of the golf grip towel) has an opening 24 that allows access to a pocket 26 formed within the first and second panels 12, 14.

Figure 3:
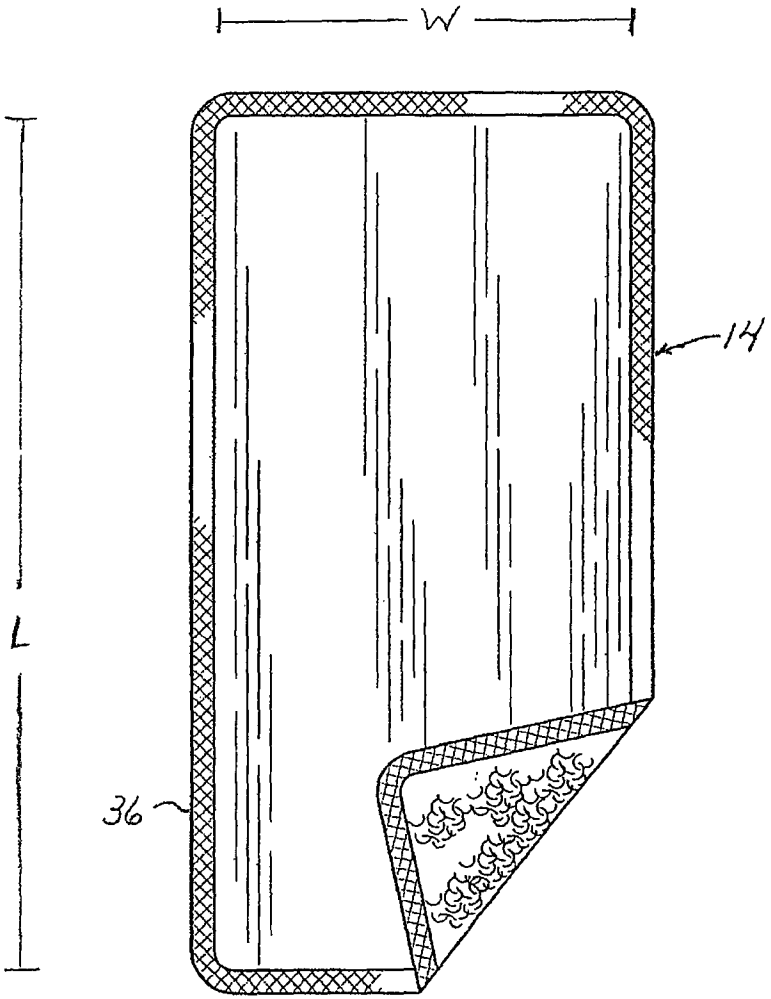
FIG. 3 is a front elevational view of the second panel.
Figure 2:
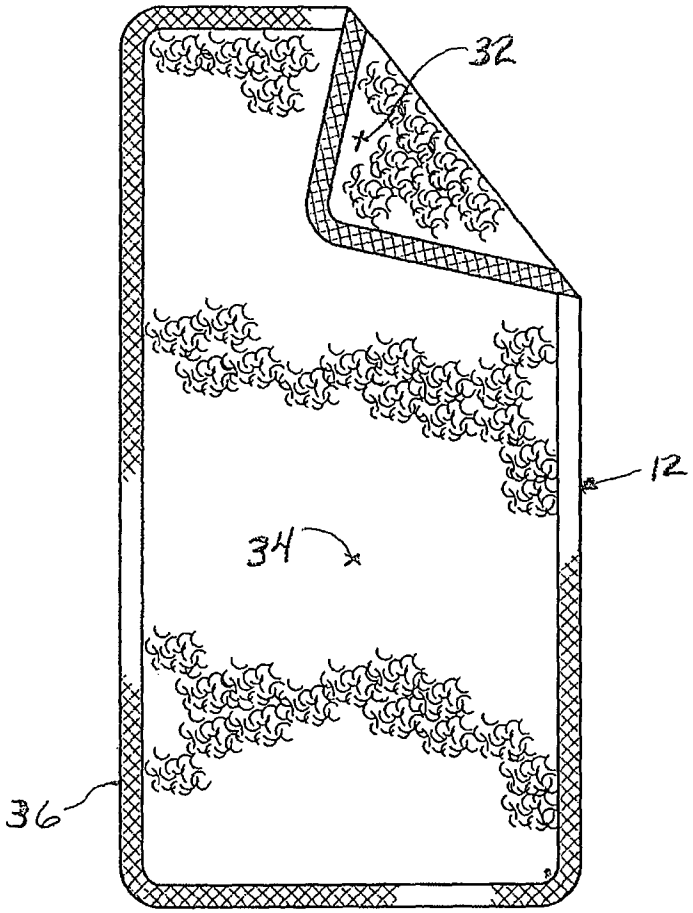
FIG. 2 is a front elevational view of the first panel.

As best shown in FIGS. 2 and 3, pocket 26 is defined essentially by the length (L) and width (W) of the panels 12, 14. The pocket 26 is of a size sufficient to at least cover a plurality of handles 28 of golf clubs 30 shown in dashed lines in FIG. 1. The handles 28 are also referred to herein as golf club grips and these two terms are used interchangeably herein. The golf grip towel 10 is multi-functional and allows the golfer to use the golf grip towel as a towel or as a protective cover for the golf club handles when the golf clubs are out of the golf bag. The material of the second panel 14 keeps the golf grips dry and clean when the golf clubs are laid on the ground. The absorbent material of the first panel 12 can be used as the towel.

The golf towel 10 may optionally include a first panel 12 with two sides having different textures. The inner side 32 of panel 12 which is the inside material forming the pocket 26 can be an abrasive cloth fiber material for cleaning dirt and debris from the grooves on a club head or the grip. The second side 34 of panel 12 which is located on the outside can be an absorbent material and used for wiping the golf equipment or golfer's hands. The second panel 14 can be a soft suede moisture resistant material on both its inner and outer surfaces and for keeping the golf grips dry when the clubs are laid on a fairway or on a fringe by the green.

Both panels 12, 14 are preferably made of a micro fiber type of material such as a blend of 70% polyester and 30% polyamide as is well known in the textile industry, or any cloth material having the properties referred to herein. Naturally, other blends of synthetic or natural fibers or materials, or combinations of both, may be employed.

A hem 36 attached around the periphery of the panels 12, 14 not only enhances the overall appearance of the golf grip towel 10 but is useful in securing the edges 16, 18, 20, of the two panels 12, 14 together, for example, by sewing.

Figure 4:
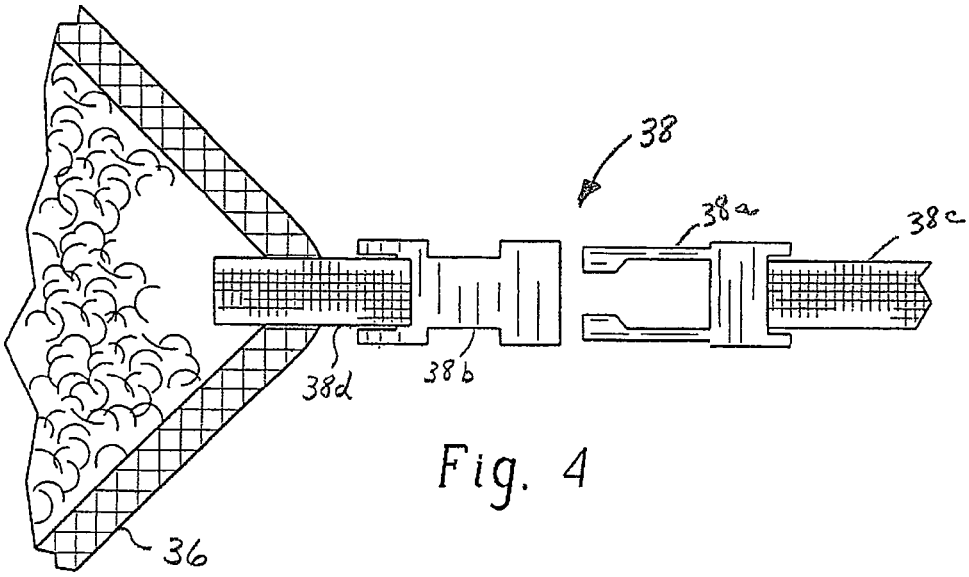
FIG. 4 is front elevational view of a portion of the golf grip towel depicting the quick disconnect clip.
Figure 5:
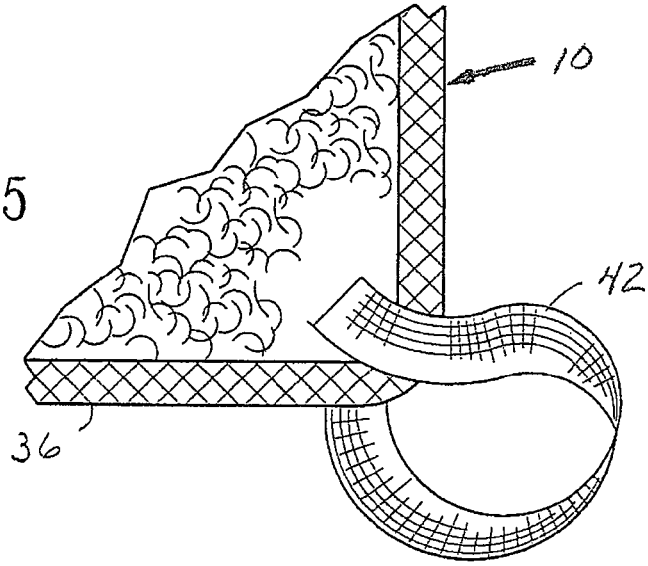
FIG. 5 is a view similar to FIG. 4 depicting an alternate embodiment for removable attachment of the golf grip towel to a golf bag (not shown).
Figure 6:
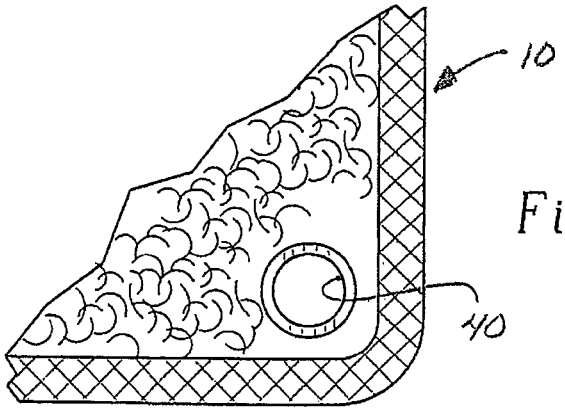
FIG. 6 is a view similar to FIGS. 4 and 5 showing yet another embodiment of a releasable attachment of the golf grip towel to the golf bag.

Golf grip towel 10 preferably includes a quick disconnect belt clip 38 of known construction positioned at the top edge of the golf grip towel 10 preferably in a corner thereof. Quick disconnect belt clip 38 is a well known and commercially available device, and is simply a releasable locking device with a male 38*a* and a female 38*b* portions that snap together in a manner commonly known. Clip 38 has two belts 38*c*, 38*d* attached to each locking portion 38*a* and 38*b* as seen in FIG. 4. The other end of the belt 38*c* includes a snap click clip or hook, like a lanyard hook, for attachment to the golf bag or golf cart (not shown). The quick disconnect belt clip 38 allows the towel 10 to be quickly released from the golf bag or golf cart. Alternative attachment devices suitable for use with the golf towel 10 include but are not limited to a grommet 40 that attaches to a snap clip or hook on the golf bag or cart, or a belt style loop 42 sewn to the golf grip towel 10 which may also be attached to the golf bag or cart by way of a snap clip or hook. Releasable clips are devices commonly used in the industry and require no detailed explanation or description here.

A slit 44 is provided in the third side 20 to extend the opening 24 and to facilitate placement of the handles 28 of the golf clubs 30 into and removal out from the pocket 26. Opening 24 and slit 44 may optionally include Velcro® fastening material at their edges for closing either the slit 44 or opening 24. Velcro is a federally registered trademark of Velcro Industries B.V.

In this manner, the golf grip towel 10 provides a way to keep golf club grips clean and dry when the golf club handles are exposed to damp or dirty conditions. The golf grip towel and attachment devices previously described allows the golfer to quickly remove the towel from the golf bag or golf cart, place the golf club handles into a protected environment within the golf grip towel, select a desired golf club for the fairway, and rest the other golf clubs directly on the ground without exposing the golf club handles to moisture, dirt, sand or other contamination.

Golf grip towel 10 may have any desired color or combination of colors, and can include source identifying or decorative indicia generally designated as 46 imprinted on or sewn in to the towel in any desired decorative pattern or manner.

While specific embodiments have been shown and described in detail to illustrate the application of the features and principles, it will be understood that the golf grip towel may be embodied otherwise without departing from such features or principles.

We claim:

1. A golf grip towel comprising:

a first panel of material, said first panel of material having a rectangular shape and being an absorbent material, said first panel having two sides, an inner side and an outer side, each side having a material of differing textures, said inner side having an abrasive cloth fiber material and said outer side having a soft cloth material for wiping;

a second panel of a moisture resistant material having a rectangular shape substantially co-extensive with said first panel, said first panel and said second panel being joined together in an overlapping relationship around an edge on a first side, an edge on a second side, and a substantial portion of an edge on a third side with a fourth side having an opening for accessing a pocket formed within said first and second panels, said pocket having a length (L) and width (W) sufficient for covering a plurality of handles of golf clubs;

said inner side of said first panel having the abrasive cloth fiber material forming an inner material inside said pocket on one side of said pocket for cleaning dirt and debris, and said moisture resistant material of said second panel forming an inner material for the other side of said pocket; and a hem for joining the first and second panels together around their edges.

2. A golf grip towel according to claim 1, further comprising a belt clip positioned at an edge of the golf grip towel, wherein said belt clip comprises a quick disconnect belt clip.

3. A golf grip towel according to claim 1, further comprising a grommet disposed at one edge of the golf grip towel.

4. A golf grip towel according to claim 1, further comprising a loop disposed at one edge of the golf grip towel.

5. A golf grip towel according to claim 1, wherein said opening extends up said third side of the golf grip towel for forming a slit.

6. A golf grip towel according to claim 1, wherein said second panel of material comprises a soft suede micro fiber material.

7. A golf grip towel according to claim 1, wherein said first panel of material comprises a terry cloth material.

8. A golf grip towel according to claim 1, further comprising indicia on an outer surface of the golf grip towel.

* * * * *